US006655765B2

(12) United States Patent
Kawamura et al.

(10) Patent No.: US 6,655,765 B2
(45) Date of Patent: Dec. 2, 2003

(54) REFRIGERATOR DOOR OPENER

(75) Inventors: Tadahiro Kawamura, Koka-gun (JP); Koji Suzuki, Kurita-gun (JP); Toshiyuki Moriuchi, Osaka (JP); Hidetomo Takanishi, Kusatsu (JP); Akihiko Manabe, Koka-gun (JP); Hirofumi Waki, Kusatsu (JP); Takashi Aoki, Kusatsu (JP); Katsuhiko Morimoto, Otsu (JP); Takeshi Onaka, Kurita-gun (JP); Kazuyoshi Takeuchi, Kusatsu (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 10/328,139

(22) Filed: Dec. 26, 2002

(65) Prior Publication Data

US 2003/0090187 A1 May 15, 2003

Related U.S. Application Data

(63) Continuation of application No. 09/744,913, filed on Apr. 20, 2001, now abandoned.

(30) Foreign Application Priority Data

Aug. 4, 1998 (JP) ..... 10-220048

(51) Int. Cl.[7] ..... A47B 96/00
(52) U.S. Cl. ..... 312/405; 312/296
(58) Field of Search ..... 312/405, 401, 312/222, 296; 49/478.1, 319; 292/DIG. 71, 251.5, 182, DIG. 19; 62/440

(56) References Cited

U.S. PATENT DOCUMENTS

| | | | |
|---|---|---|---|
| 1,911,432 | A | 5/1933 | Chase |
| 2,064,926 | A | 12/1936 | Kuebler |
| 2,246,342 | A | 6/1941 | Brown |
| 2,613,123 | A | 10/1952 | Patten |
| 2,659,115 | A | 11/1953 | Anderson et al. |
| 2,692,809 | A | 10/1954 | Kesling |
| 2,893,805 | A | 7/1959 | Ferguson |
| 3,240,523 | A | 3/1966 | Heimann |

FOREIGN PATENT DOCUMENTS

| | | |
|---|---|---|
| DE | 93 13 978 | 3/1994 |
| DE | 296 06 605 | 9/1996 |
| EP | 0 849 551 | 6/1998 |
| JP | 61-79976 | 4/1986 |
| JP | 1-222187 | 9/1989 |
| JP | 7-9341 | 2/1995 |
| JP | 7-41377 | 7/1995 |
| WO | 98/05908 | 2/1998 |

*Primary Examiner*—Janet M. Wikens
(74) *Attorney, Agent, or Firm*—Wenderoth, Lind & Ponack, L.L.P.

(57) ABSTRACT

A refrigerator includes a thermally insulated housing opening forwardly at a front surface thereof; a door for selectively opening and closing the opening of the housing; a magnetic gasket fitted to a portion of the door which is engageable with an open edge of the housing; a pivotally supported handle connected to the door for movement between opened and closed positions for opening and closing the door, respectively; and a trigger member drivingly coupled with the handle for movement between projected and retracted positions. The trigger member is moved from the retracted position towards the projected position, as the handle is pivoted from the closed position towards the opened position, to abut the open edge to thereby physically release a contact between the magnetic gasket and the open edge. The trigger member is spaced a distance from an abutment face of the open edge of the housing so long as the handle is held in the closed position, but temporarily brought into engagement with the abutment face of the housing as the handle is pivoted from the closed position towards the opened position to open the door.

35 Claims, 15 Drawing Sheets

REFRIGERATOR DOOR OPENER

This application is a continuation of application Ser. No. 09/744,913 filed Apr. 20, 2001, now abandoned.

TECHNICAL FIELD

The present invention generally relates to a refrigerator and, more particularly, to a trigger mechanism built in a door handle assembly for forcibly opening a door a predetermined distance against magnetic attraction used to keep the door shut.

BACKGROUND ART

A refrigerator commercially available in the market nowadays is provided with a plurality of doors, at least one of which is hingedly supported at one side thereof for swinging between opened and closed positions about a hinge. This hingedly supported door is generally provided with one or more storage shelves fixedly or removably fitted to an interior surface of the hingedly supported door for accommodating bottles, cans and/or canisters. In addition, each of the doors has a magnetic gasket fitted thereto so that when a respective door is in position to close an opening leading into an associated refrigerator compartment, a substantially gas-tight seal can be created between the respective door and a front edge of the refrigerator to avoid any possible leakage of chilled air from an interior of a refrigerator housing to an exterior thereof. As is well known to those skilled in the art, the magnetic gasket is of a design in which a permanent magnet is embedded to develop a magnetic force of attraction by which the respective door can be kept shut.

It has been experienced that in opening the hingedly supported door a relatively large amount of pulling force is necessary to overcome the magnetic force of attraction developed by the magnetic gasket between the door and the front edge of the refrigerator housing. This is particularly true where a substantial weight is imposed on the storage shelves by placement of filled bottles, cans and canisters. imposed on the storage shelves by placement of filled bottles, cans and canisters. Considering that the hingedly supported door is installed at a top region of the refrigerator, selective opening and closure of the door so loaded with the filled bottles, cans and canisters on the shelves is indeed a laborious job for a short user.

When it comes to a drawing door, the drawing door generally carries a storage container for accommodating perishables and/or any other food material therein. However, the deeper the storage container, the heavier the entire assembly thereof, and therefore a relatively large amount of pulling force is required to draw the drawing door from a closed position towards an open position.

In order to minimize a force required to open the drawing door, Japanese Laid-open Utility Model Publication No. 7-41377, published Jul. 21, 1995, discloses a door trigger mechanism comprising a generally elongated operating member movably concealed behind a door handle and having each of its opposite ends formed with a trigger arm. The trigger arms on the opposite ends of the operating member are engaged in one of creases in the magnetic gasket so that when the operating member is pulled forward during manipulation of the door handle, the trigger arms are moved forwardly in a direction away from a peripheral edge of the refrigerator housing to forcibly compress the magnetic gasket to thereby create gaps between the magnetic gasket and the peripheral edge of the refrigerator housing, thereby making it easy to open the drawing door.

The idea suggested in the above mentioned publication is applicable where the magnetic gasket is of a cross-sectional shape similar to a bellows having a plurality of creases extending over an entire periphery of the magnetic gasket so that the magnetic gasket can be inwardly compressed when the trigger arms are moved forwardly. However, since the trigger arms are engaged in one of the creases in the magnetic gasket in touch with the magnetic gasket, frequent use of the operating member would result in damage to the magnetic gasket. Once the magnetic gasket is damaged locally, a gas-tight seal will no longer be established between the peripheral edge of the refrigerator housing and the magnetic gasket.

On the other hand, Japanese Laid-open Patent Publication No. 61-79976, published Apr. 23, 1986, discloses a refrigerator door hingedly supported by a hinge axis to a refrigerator housing, and a handle movably fitted to a portion of the refrigerator door opposite to the hinge axis. The handle is movably carried by the door by virtue of an elongated operating bar connected at one end hingedly to the hinge axis of the door and at an opposite end to the handle. A trigger protuberance is fixedly mounted on a generally intermediate portion of the operating bar so as to protrude towards a peripheral edge of the refrigerator housing. This door trigger mechanism is so designed that when the handle is pushed, the trigger protuberance is brought into abutment with the peripheral edge of the refrigerator housing to forcibly separate a magnetic gasket, fast with the door, from the peripheral edge of the refrigerator housing.

However, according to the above mentioned patent publication, once the magnetic gasket, fast with the door, has been forcibly separated a distance from the peripheral edge of the refrigerator housing by the action of the trigger protuberance, a user has to pull the handle forward to open the refrigerator door. This means that the user has to perform two successive steps of pushing the handle to create a slight gap between the door and the refrigerator housing, and then grasping the handle to pull the latter to thereby open the door. This is indeed a complicated procedure.

A refrigerator door trigger mechanism employing a solenoid unit and an associated electric switch is disclosed in, for example, Japanese Laid-open Patent Publication No. 1-222187, published Sep. 5, 1989, and Japanese Patent Publication No. 7-9341, first published Sep. 5, 1989 under Laid-open Patent Publication No. 1-222186. While use of an electrically operated trigger mechanism appears to be sophisticated, not only does the trigger mechanism require electricity accompanied by increase of electric power consumption of a refrigerator as a whole, but use of the electrically operated trigger mechanism tends to result in an increase of costs for manufacture of the refrigerator. In addition, this requires a complicated operating procedure of activating the switch to energize the solenoid unit, and then pulling a handle forward to open a door.

SUMMARY OF THE INVENTION

The present invention is intended to provide a door trigger mechanism built in a door handle assembly for forcibly opening a door a predetermined distance against magnetic force of attraction developed between a magnetic gasket, fast with the door, and a peripheral open edge of a refrigerator housing to keep the door shut.

To this end, one aspect of the present invention provides a refrigerator which comprises a thermally insulated housing opening forwardly at a front surface thereof; a door for selectively opening and closing the opening of the thermally insulated housing; a magnetic gasket positioned between the door and the thermally insulated housing and fitted to a portion of the door which is engageable with an open edge of the thermally insulated housing; a pivotally supported handle connected to the door for movement between opened and closed positions for opening and closing the door, respectively; and a trigger member drivingly coupled with the handle for movement between projected and retracted positions. With this structure, the trigger member is moved from the retracted position towards the projected position, as the handle is pivoted from the closed position towards the opened position, to abut the open edge to thereby physically release a contact between the magnetic gasket and the open edge. The trigger member is spaced a distance from an abutment face of the open edge of the thermally insulated housing so long as the handle is held in the closed position, but temporarily brought into engagement with the abutment face of the thermally insulated housing as the handle is pivoted from the closed position towards the opened position to open the door.

According to the present invention, a simple pull of the refrigerator door in an attempt to open the door is accompanied by movement of the trigger member from the retracted position towards the projected position, and subsequent opening of the refrigerator door. Accordingly, no extra complicated procedure is required such as observed in prior art trigger mechanisms.

Preferably, the trigger member is positioned within an area encompassed by a length of the handle to allow the trigger mechanism to be compactly assembled.

The concept of the present invention is equally applicable to one or more drawing doors employed in a refrigerator with or without a hingedly supported door.

BRIEF DESCRIPTION OF THE DRAWINGS

The present invention will become readily understood from the following description of preferred embodiments thereof made with reference to the accompanying drawings, in which.

DESCRIPTION OF THE PREFERRED EMBODIMENTS

Figure 1:
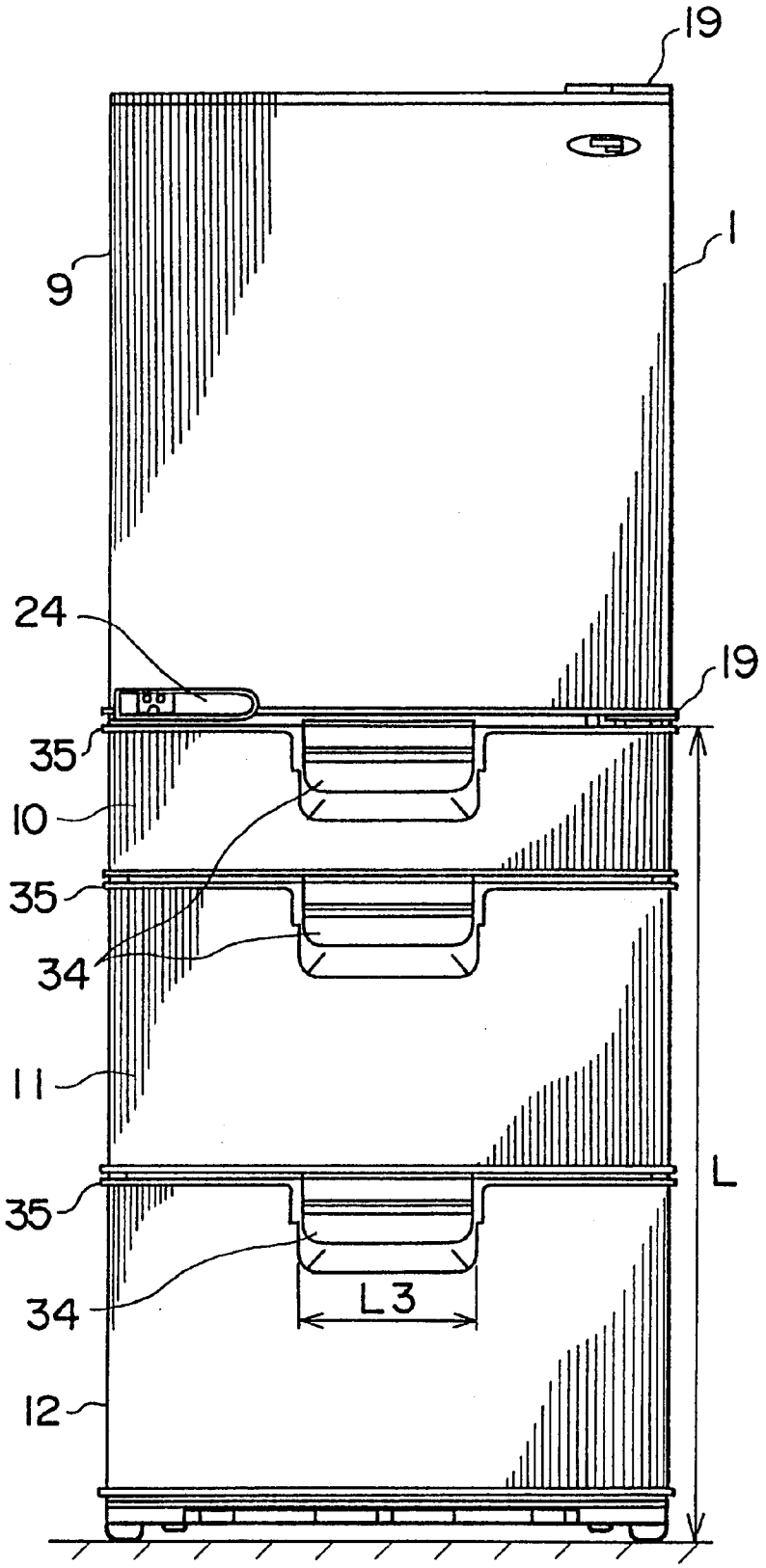
FIG. 1 is a front elevational view of a refrigerator according to a first preferred embodiment of the present invention.

Hereinafter, various preferred embodiments of the present invention will be described in detail with reference to the accompanying drawings. It is, however, to be noted that throughout the accompanying drawings like parts are designated by like reference numerals.

First Embodiment (FIGS. 1 to 9)

Figure 2:
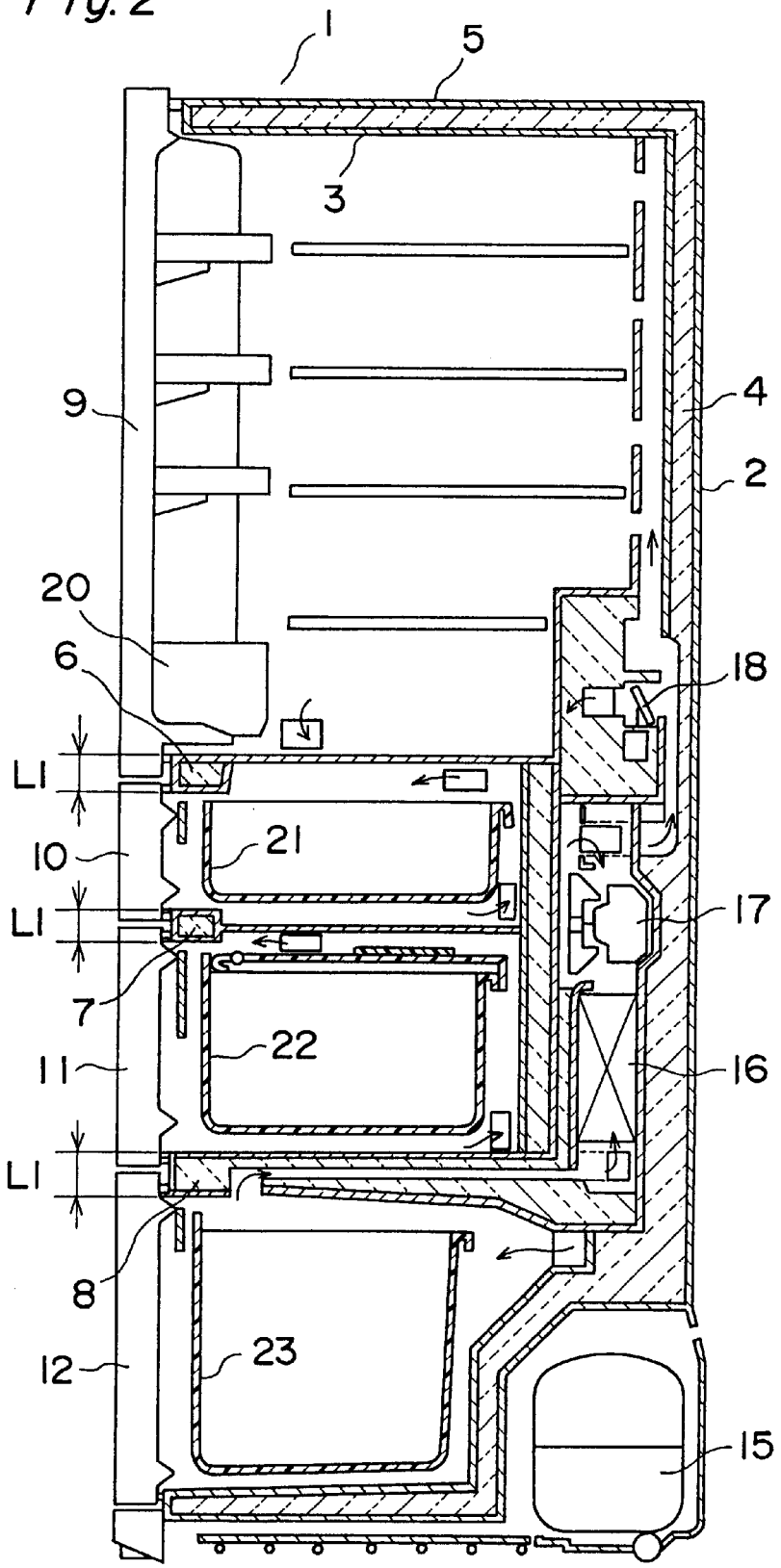
FIG. 2 is a longitudinal sectional view of the refrigerator shown in FIG. 1.

A refrigerator according to a first embodiment of the present invention is shown in FIGS. 1 to 9 and is generally identified by 1 in FIGS. 1 and 2. The refrigerator 1 comprises a generally rectangular box-like, thermally insulated upright housing 5 including an outer housing component 2 opening forwardly, an inner housing component 3 similarly opening forwardly and accommodated within the outer housing component 2, and an adiabatic material 4 filled in a space delimited between the outer and inner housing components 2 and 3, adiabatic partition walls 6, 7 and 8 dividing an interior of the refrigerator housing 5 into four compartments each having a front opening, and four doors 9, 10, 11 and 12 for selectively opening and closing respective compartments.

The outer housing component 2 of the housing 5 has a front edge formed with a flange 2*a* and, similarly, the inner housing component 3 has a front edge formed with a flange 3*a*. In an assembled condition of the refrigerator housing 5, the flange 2*a* integral with the front edge of the outer housing component 2 is overlapped with the flange 3*a* integral with the front edge of the inner housing component 3, made of a synthetic resin, to thereby define an open edge.

Each of the adiabatic partition walls 6 to 8 has a front face provided with a partition brim 13 made of metal. Each partition brim 13 has a thickness L1 which is greater than a wall thickness L2 of the refrigerator housing 5. Also, each partition brim 13 may be made of a synthetic resin, in which case it is effective to any possible leakage of chilled air from a corresponding compartment via thermal conduction.

Reference numeral 14 represents a magnetic gasket in which a flexible magnet 14*b* is embedded. This magnetic gasket 14 has a rectangular configuration and is fitted to each of the doors 9, 10, 11 and 12 so that the magnetic gasket 14 can be magnetically attracted to the open edge to thereby avoid any possible leakage of chilled air.

Reference numeral 15 represents a compressor disposed beneath the refrigerator housing 5. A cooler 16 is positioned above the compressor 15 and a blower 17 for forcibly circulating chilled air into each of the compartments is also positioned above the cooler 16. Reference numeral 18 represents a damper for guiding the chilled air, circulated by the blower 17, into a refrigerating compartment. Temperature inside the refrigerator housing 5 is so controlled that the four compartments inside the refrigerator housing 5 can define a refrigerating compartment, a freezer/refrigerating selectable compartment, a freezer compartment and a vegetable compartment, respectively, in order from a top of the refrigerator housing 5. In any event, the refrigerator itself may be of any known construction.

Each of the doors 9 to 12 is used to selectively open and close an associated compartment in the refrigerator housing 5. Topmost door 9 has top and bottom right corner areas, as viewed in FIG. 1, connected to the refrigerator housing 5 by virtue of coaxially aligned hinges 19 for selectively opening and closing the front opening leading to the refrigerating compartment. This topmost door 9 has a stack of shelves 20 arranged one above the other on an inside surface thereof facing towards the refrigerating compartment for accommodating bottles, cans, canisters and eggs.

Each of the remaining doors 10, 11 and 12 is a drawing door that can be moved between a forwardly drawn, open position and a rearwardly retracted, closed position along guide rails (not shown), and that includes a corresponding storage container 21, 22 or 23 fitted thereto while opening upwardly. As far as depth and capacity are concerned, the storage container 21 fitted to uppermost drawing door 10 has the smallest of all of the storage containers.

The uppermost drawing door 10 is held at a, height L above a support surface, for example, a kitchen floor which is not greater than 1 meter. This particular height L being not greater than 1 meter is considered optimum for most Japanese women to remove or place food material into the storage container 21 without being interfered with by the other drawing doors 11 and 12, where the refrigerating compartment is defined at a top of the refrigerator housing 5.

Reference numeral 24 represents a hinged handle having a grip 25 extending substantially horizontally below a lower portion of hingedly supported door 9 opposite to lowermost hinge 19. A portion of the hinged handle 24 is formed integrally with a trigger piece 26 made of a synthetic resin and engageable with the partition brim 13 that forms a part of the open edge of the refrigerator housing 5. This trigger piece 26 is positioned on a lower face of a lower decorative plate 9*a* of the hingedly supported door 9 and at a location adjacent and outside one corner of the rectangular magnetic gasket 14. Positioning of the trigger piece 26 outside the corner of the rectangular magnetic gasket 14 is particularly advantageous in avoiding a possibility of a gas-tight seal being impaired.

Reference numerals 27 and 28 represent support brackets. The support bracket 27 is used for connecting the hinged handle 24 to the hingedly supported door 9 for pivotal movement in a plane substantially perpendicular to the hingedly supported door 9 between opened and closed positions. This support bracket 27 is rigidly secured by virtue of a plurality of set screws 29 to the decorative plate 9*a* concealing a lower surface of the trigger piece 26, and includes a lug 30 protruding forwardly from the hingedly supported door 9. On the other hand, the support bracket 28 is rigidly secured by virtue of a plurality of set screws 29 to a front surface of the hingedly supported door 9 and has a lug 31 formed integrally therewith by bending so as to protrude in a direction conforming to a direction of protrusion of the lug 30 in a face-to-face relationship with the lug 30.

Figure 3:
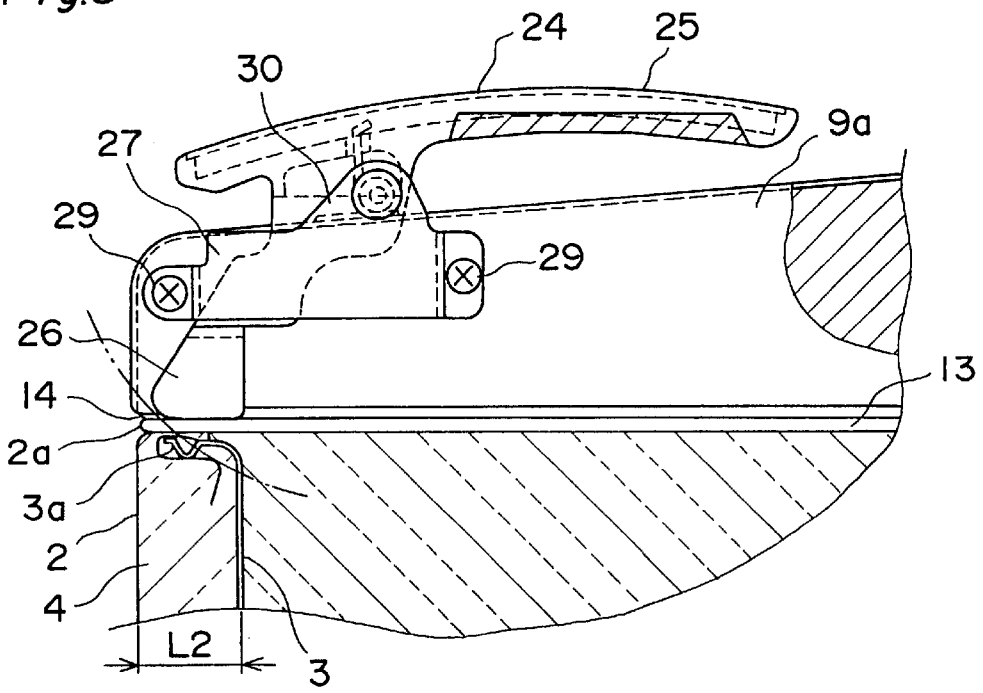
FIGS. 3 and 4 are fragmentary sectional views, on an enlarged scale, of a portion of the refrigerator of FIG. 1 with a door handle of a hingedly supported door assembly held in closed and opened positions, respectively, which portion is viewed from a bottom of the refrigerator.
Figure 4:
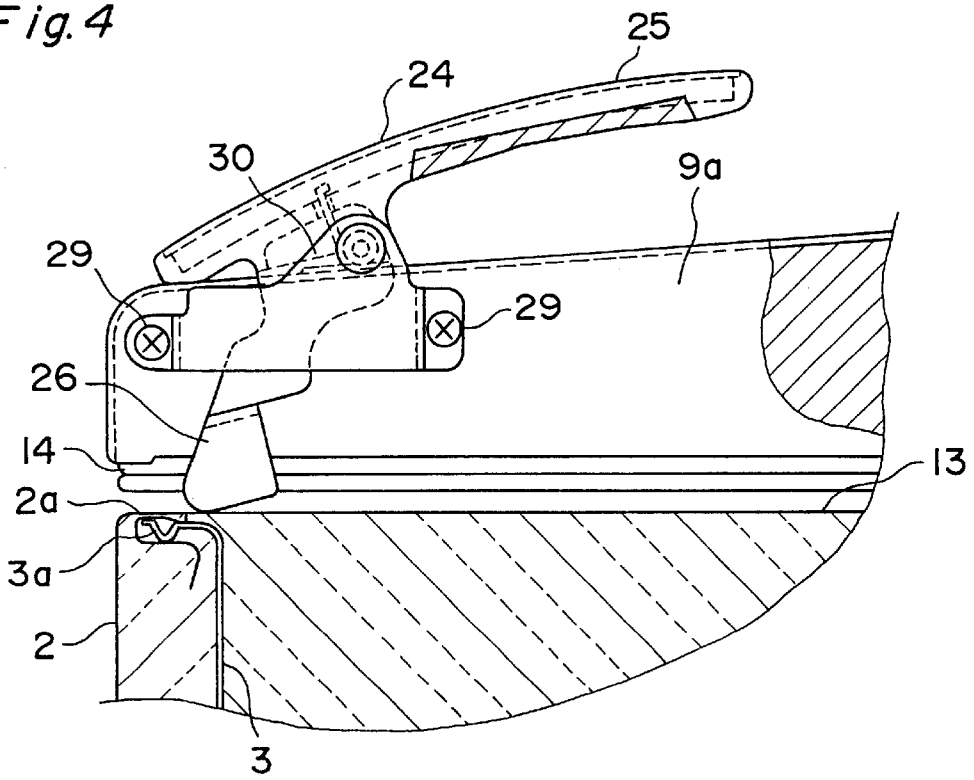
Figure 5:
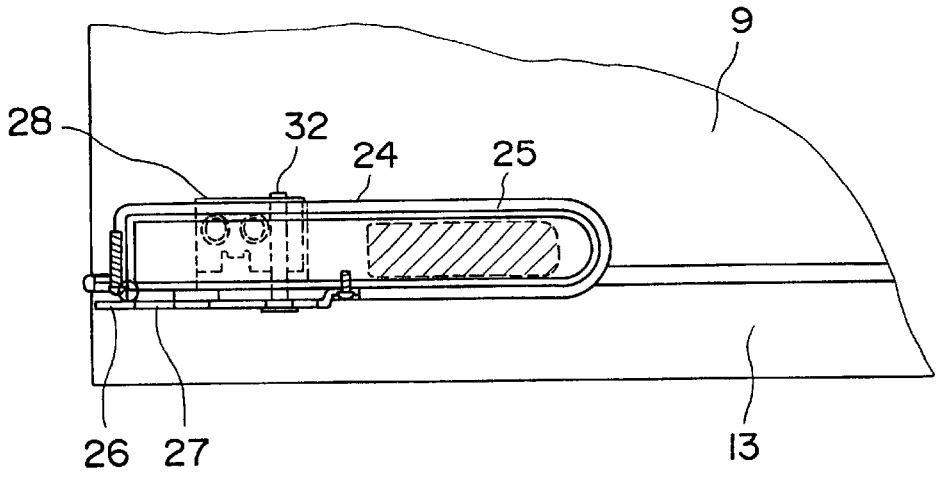
FIG. 5 is a fragmentary front elevational view, on an enlarged scale, of that portion of the refrigerator of FIG. 1, showing the door handle of the hingedly supported door.
Figure 6:
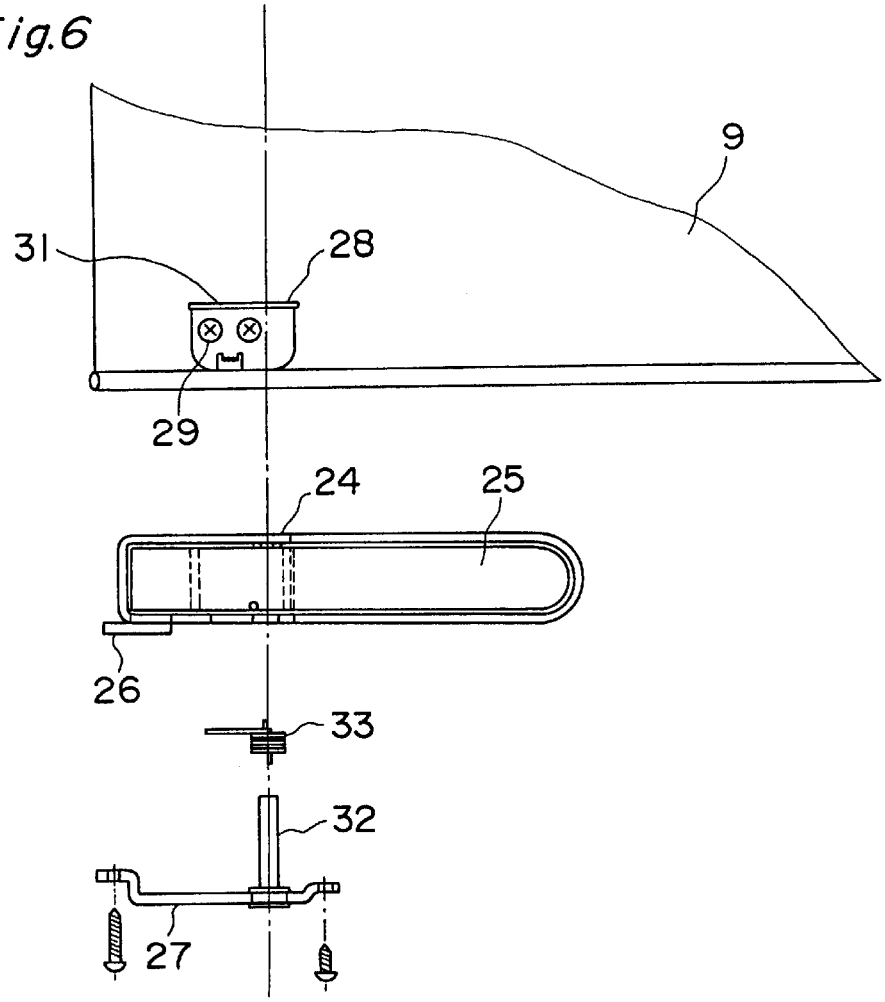
FIG. 6 is an exploded view of the door handle shown in FIG. 5.

The hinged handle 24 includes a hinge pin 32 extending across a thickness of the hinged handle 24 with its opposite ends connected respectively to the mutually confronting lugs 30 and 31. Accordingly, the hinged handle 24 can pivot between an opened and closed position about this hinge pin 32. The grip 25 of the hinged handle 24 and the trigger piece 26 are held in such a positional relationship that the trigger piece 26 can occupy a position opposite to the hinge, i.e., on one side of the hinge pin 32 remote from the grip 25. An elastic member 33 such as, for example, a coiled spring is loosely mounted on the hinge pin 32 to urge the hinged handle 24 in a clockwise direction as viewed in FIG. 3 to assume the closed position unless a pulling force is applied to the hinged handle 24. Thus, it will readily be seen that when the hinged handle 24 is pulled forwardly, the hinged handle 24 pivots counterclockwise about the hinge pin 32 as viewed in FIG. 3 against a biasing force of the elastic member 33. It is to be noted that so long as the hinged handle 24 is manipulated, i.e., held in the closed position as shown in FIG. 3, the trigger piece 26 is spaced a distance from the partition brim 13 and is therefore out of contact with the partition brim 13.

The hinged handle 24 is made of a material mixed with an antimicrobial agent to render the hinged handle 24 to have an antimicrobial characteristic, and the grip 25 has at least a front surface knurled to provide surface irregularities effective to avoid slippage.

Reference numeral 34 represents a pivot handle mounted on each of the drawing doors 10, 11 and 12. This handle 34 is positioned adjacent a top middle portion of an associated drawing door 10, 11 or 12. The drawing door 10 (as well as any of the other drawing doors 11 and 12, although all of the drawing doors 10 to 12 have a varying height) has a decorative plate 35 fixedly mounted on an upper edge thereof. This decorative plate 35 has a portion thereof formed with a cavity 36 recessed downwardly thereof as viewed in FIGS. 7 and 8, and a trigger piece 37 is disposed within the cavity 36 for sliding movement between retracted and projected positions, as shown respectively in FIGS. 7 and 8, in a direction substantially perpendicular to the drawing door 10 and also to an associated partition brim 13. A portion of a front panel 10*a* of the drawing door 10 is formed with a recess 38 for accommodating the slidable trigger piece 37.

Figure 7:
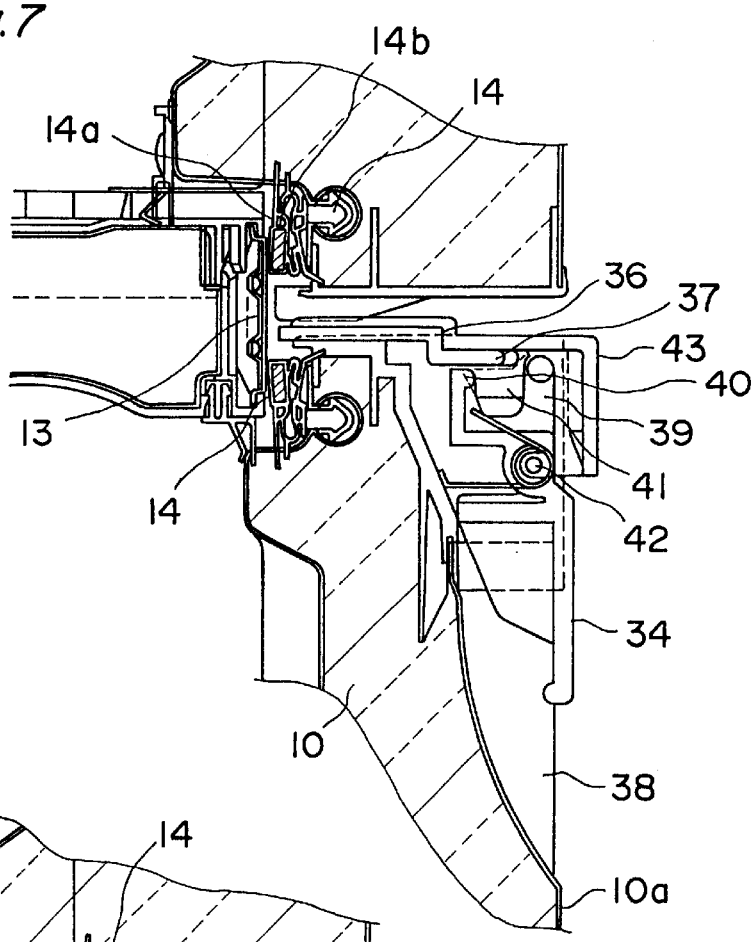
FIGS. 7 and 8 are fragmentary side sectional views, on an enlarged scale, showing a drawing door in the refrigerator of FIG. 1 with the door handle held in closed and opened positions, respectively.
Figure 8:
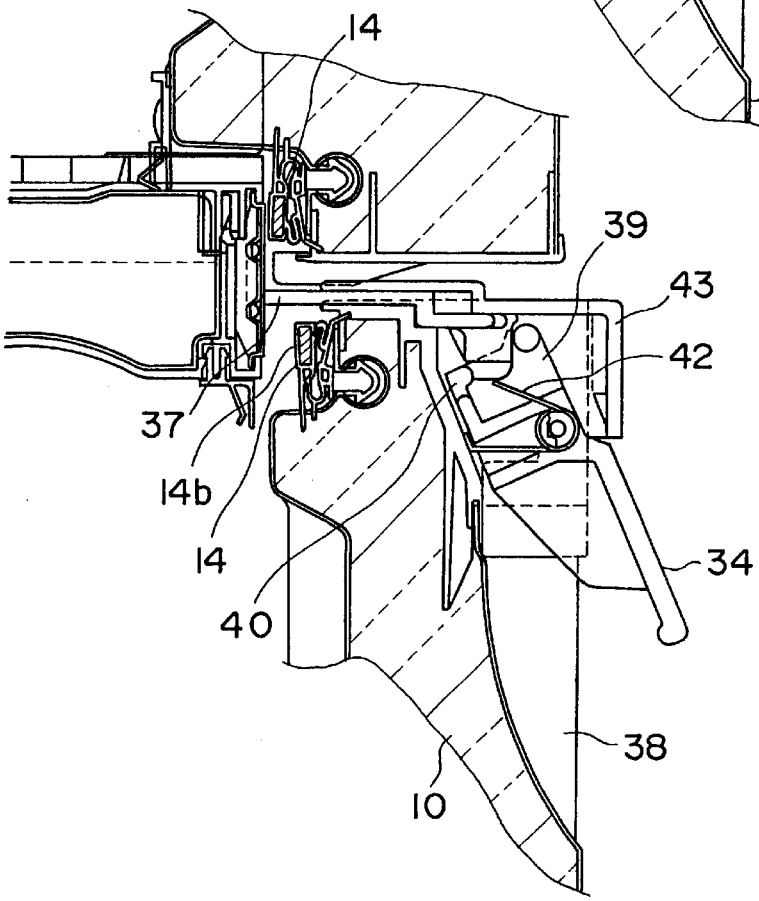
Figures 9, 10:
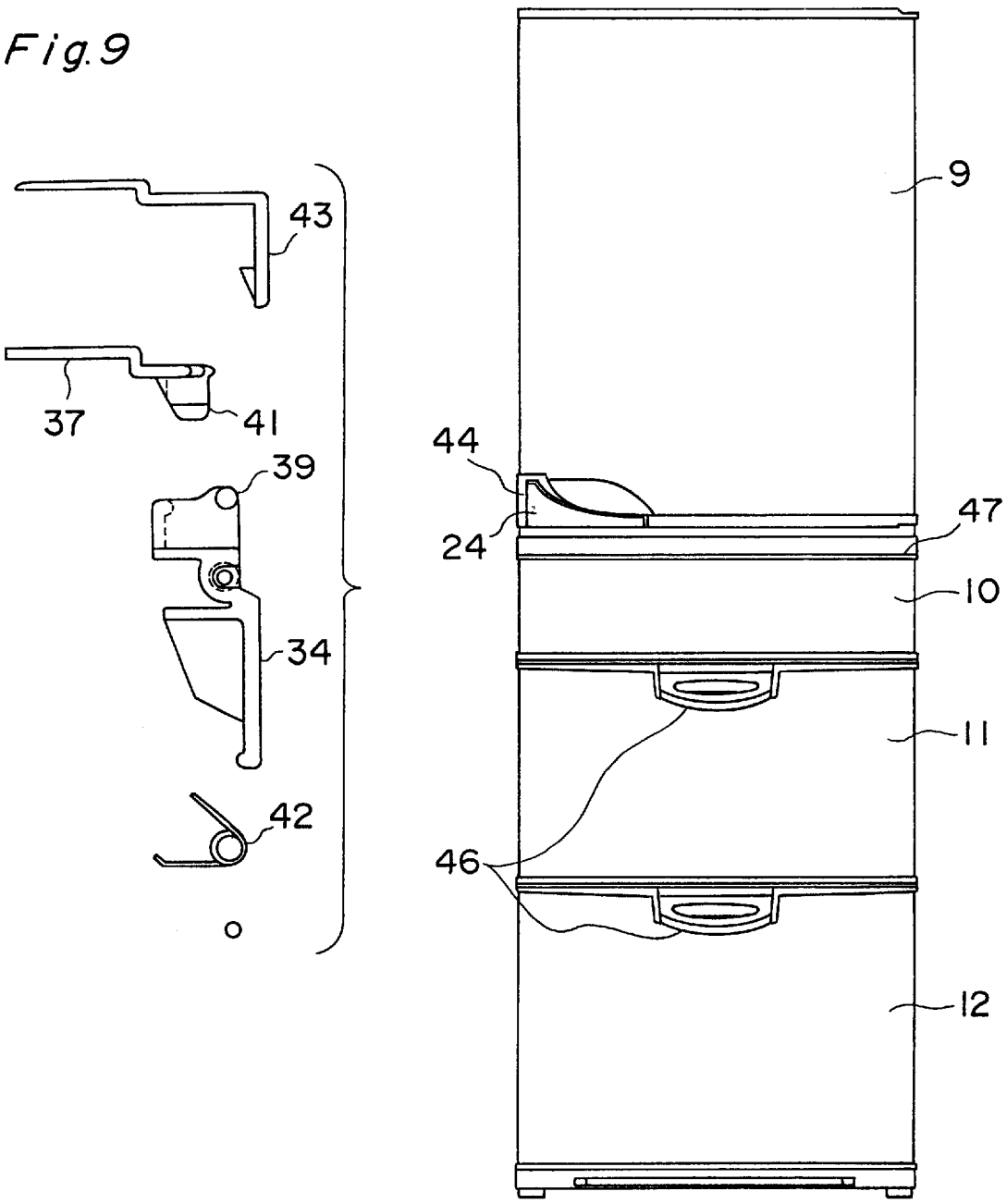
FIG. 9 is an exploded view of the door handle of the drawing door shown in FIGS. 7 and 8.
FIG. 10 is a front elevational view of a refrigerator according to a second preferred embodiment of the present invention.
Figure 11:
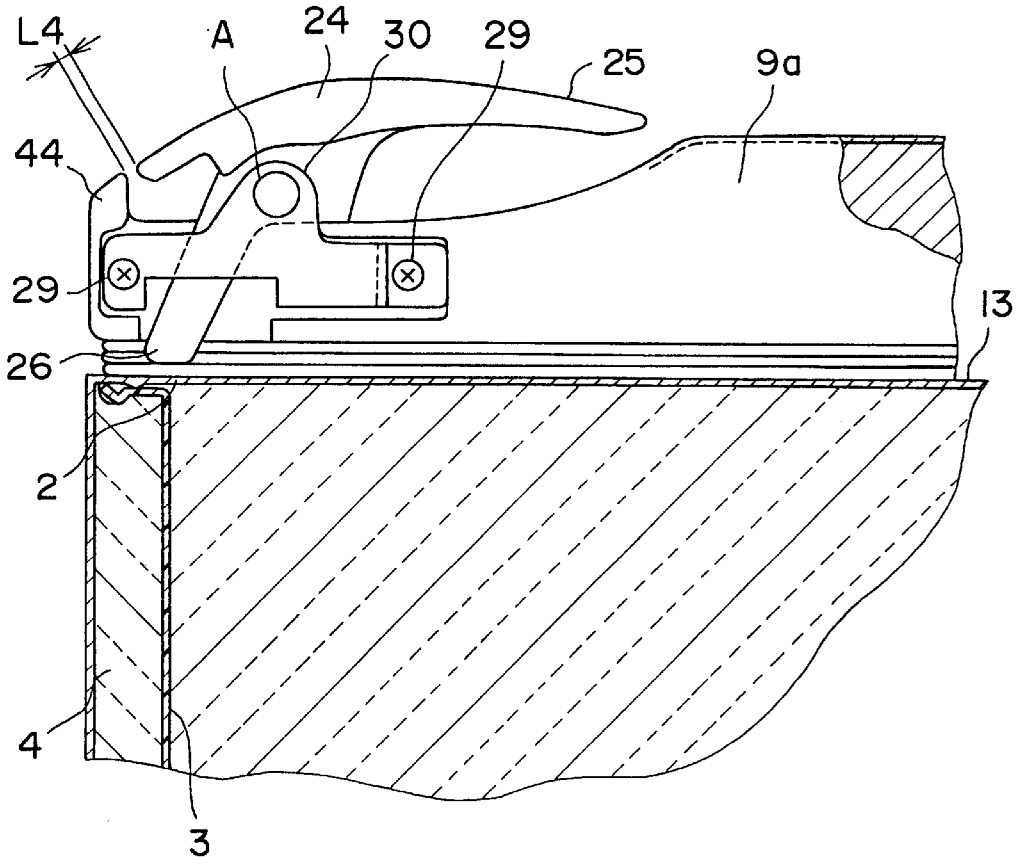
FIG. 11 is a fragmentary sectional view of, on an enlarged scale, a portion of the refrigerator of FIG. 10 with a door handle of a hingedly supported door assembly held in a closed position.
Figure 12:
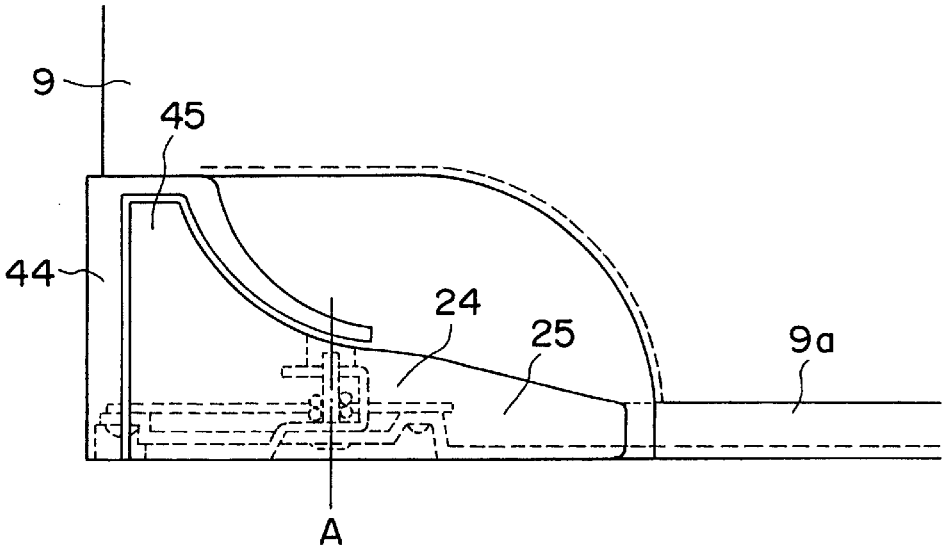
FIG. 12 is a fragmentary front elevational view of the portion of the refrigerator showing the door handle shown in FIG. 11.

The pivot handle 34 has an upper portion pivotally supported within the recess 38 and is formed integrally with a presser face 39 for pressing the slidable trigger piece 37 from the retracted position towards the projected position in response to movement of the pivot handle 34 from a closed position, as shown in FIG. 7, towards an opened position, as shown in FIG. 8. The pivot handle 34 is also formed intergrally with a pull face 40 for returning the slidable trigger piece 37 from the projected position towards the retracted position in response to movement of the pivot handle from the opened position towards the closed position as biased by an elastic member 42 such as, for example, a coiled spring. The slidable trigger piece 37 is formed with a projection 41 selectively engageable with the presser face 39 and the pull face 40. The elastic member 42 used to urge the pivot handle 34 normally towards the closed position is mounted on the pivot handle 34 and, for this purpose has one end engaged with the projection 41 and an opposite end engaged in the recess 38.

With the slidable trigger piece 37 held in the retracted position as shown in FIG. 8, the slidable trigger piece 37 is spaced a slight distance from an adjacent partition brim 13. Reference numeral 43 represents a cover plate overhanging the slidable trigger piece 37 and also overlaying a front top area of the pivot handle 34. The slidable trigger piece 37 is positioned within an area encompassed by a length L3 of the pivot handle 34 as measured in a direction widthwise of the refrigerator housing 5 so that a trigger mechanism can be compactly assembled.

It is to be noted that the pivot handle 34 and its associated component parts including the slidable trigger piece 37, which has been described in association with the drawing door 10 is equally employed in each of the remaining drawing doors 11 and 12.

Hereinafter, respective operations of the handles employed in the refrigerator according to the present invention will be described.

The hinged handle 24 has the grip 25 of a design that permits a user's hand to easily grip the hinged handle 24 from any of three directions, top, bottom and non-fixed portion, and is capable of opening the hingedly supported door 9. When the hinged handle 24 is pivoted counterclockwise about the hinge pin 32 when the hingedly supported door 9 is desired to be opened, the trigger piece 26 moves a slight distance and is then brought into contact with partition brim 13. Then, the hingedly supported door 9 is pivoted clockwise, as viewed in FIG. 2, about the hinge pins 19. Further opening of the hingedly supported door 9 can be achieved when the user opens the hingedly supported door 9 in the clockwise direction.

More specifically, since the trigger piece 26 can move freely during pivoting of the hinged handle 24, it can be moved by application of a light force thereto. When this manipulation is continued, the trigger piece 26 is temporarily brought into contact with partition brim 13 to partially separate the magnetic gasket, rigid with the hingedly supported door 9, from the open edge and, therefrom further opening of the hingedly supported door 9 can be achieved with a slight force and without being affected by magnetic force of attraction developed between the magnetic gasket 14 and a front of partition brim 13. Release of the user's hand from the grip 25 of the handle 24 results in the handle 24 being returned to an initial position by effect of a biasing force of the elastic member 33.

When food material is desired to be removed from one of the storage containers, for example, storage container 21, associated drawing door 10 has to be pulled forwardly. For this purpose, the user must insert his or her hand into the recess 38 to position fingers between the pivot handle 34 and a bottom of the recess 38, and then pull the pivot handle 34 forwardly to allow the pivot handle 34 to be angularly moved or pivoted from closed position towards an opened position. This pivot of the pivot handle 34 towards the opened position results in contact of the presser face 39 with the projection 41 and, therefore, further pivot of the pivot handle 34 towards the opened position is accompanied by sliding movement of the trigger piece 37 from the retracted position towards the projected position.

As a result of abutment of the trigger piece 37 with partition brim 13, the magnetic gasket rigid with the drawing door 10, then held in tight contact with partition brim 13 via magnetic force of attraction, is separated a distance away from partition brim 13 so that further movement of the drawing door 10 towards the opened position can be achieved by application of a light pulling force thereto. It is to be noted that after the magnetic gasket 14 has been forcibly separated from partition brim 13 by action of the trigger piece 37, pulling of the drawing door 10 to make access to the storage container 21 can be carried out smoothly in a manner generally performed with that of a conventional refrigerator. As a matter of design, release of the hand from the pivot handle 34 results in automatic return of the pivot handle 34 to the closed position by effect of a biasing force of the elastic member 42, with the trigger piece 37 consequently brought back to the retracted position by engagement between the pull face 40 and the projection 41 and, therefore, when the drawing door 10 once opened is to be closed, a simple push is sufficient and the trigger piece 37 does not abut partition brim 13 when the drawing door 10 is thus closed.

In the structure described above, since the pivot handle 34 for each of the drawing doors 10 to 12 is positioned intermediate of a width of an associated drawing door, there is no possibility that a force a user applies to any of the drawing doors will be biased. Also, since the trigger piece 37 is arranged within a dimension of the pivot handle 34, there is no possibility that the user will feel a sense of incongruity at any location on the handle 34, which would otherwise occur when the trigger piece 37 is brought into abutment with partition brim 13.

Also, since material for the hinged handle 24 is mixed with an antimicrobial agent to render the handle 24 to have an antimicrobial characteristic, the handle 24, which tends to be contaminated through contact with a user's hand, can advantageously be kept sanitary and clean. In addition, formation of the knurling on the grip 25 of the handle to provide fine surface irregularities is effective to avoid any possible slippage of a user's hand grasping the handle 24 to thereby improve operability.

Furthermore, since by allowing the trigger pieces 26 and 27 to abut associated partition brims 13 an abutment position of a dimension longer than a thickness of the refrigerator housing 5 can be secured, a simple adjustment can be achieved as compared with adjustment of abutment with an outer casing. It is to be noted that although in the foregoing embodiment the trigger piece is not held in abutment with a wall pressure of the refrigerator housing, there should be no problem even if it is held in abutment therewith.

It is to be noted that the term "open edge" hereinbefore and hereinafter used, and also used in the appended claims, is intended to mean any of the front and partition brims.

Second Embodiment (FIGS. 10 to 15)

Referring now to FIGS. 10 to 15, reference numeral 44 represents a covering provided on a portion of hinged handle 24 opposite to hinge A so as to cover a region extending from hinge A to an extension face 45 of a portion of the handle 24 opposite to grip 25. A gap between the covering 44 and one end of the extension face 45 is of a value L4 which is preferably as small as possible.

However, since when hingedly supported door 9 is to be opened, this extension face 45 moves in a direction closely towards the door and counter to a direction of movement of the grip 25 of the handle 24, there is no possibility of a user's hand being jammed.

Drawing door 10 has a storage container which is smaller, but lighter than respective storage containers of any of drawing doors 11 and 12 and, therefore, handle 47 associated therewith is of any known pull-type structure, whereas only drawing doors 11 and 12 are provided with a pivotable grip handle 46 as will be described hereinafter.

The drawing door 11 (as well as drawing door 12, although these drawing doors 11 and 12 have a varying height) has a decorative plate 48 fixedly mounted on an upper edge thereof. This decorative plate 48 has a portion thereof formed with a cavity 49 recessed downwardly as viewed in FIG. 15, and a slidable trigger piece 50 is disposed within the cavity 49 for sliding movement between retracted and projected positions, as shown respectively in FIGS. 13 and 14, in a direction substantially perpendicular to the drawing door 11 and also to associated partition brim 13. A portion of front panel 11*a* of the drawing door 11 is formed with a recess 51 for accommodating the slidable trigger piece 50.

Figure 13:
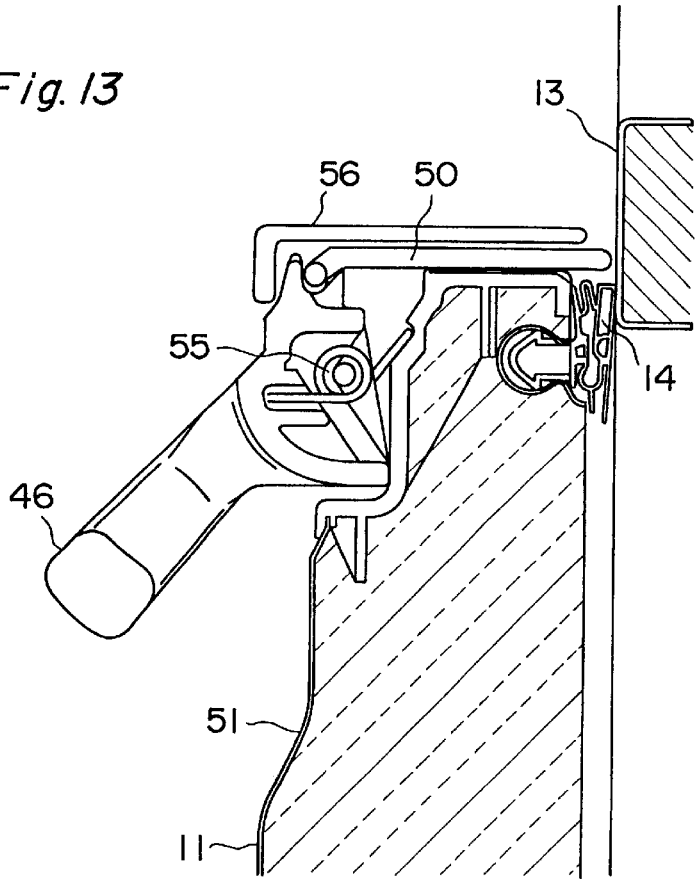
FIGS. 13 and 14 are fragmentary side sectional views, on an enlarged scale, showing a drawing door in the refrigerator of FIG. 10 with a door handle held in closed and opened positions, respectively.
Figure 14:
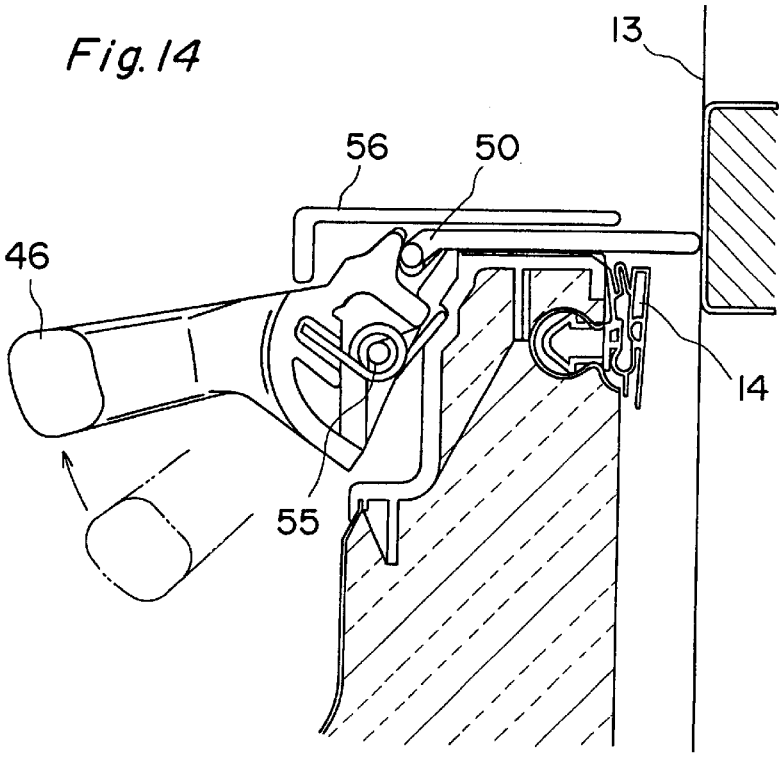
Figure 15:
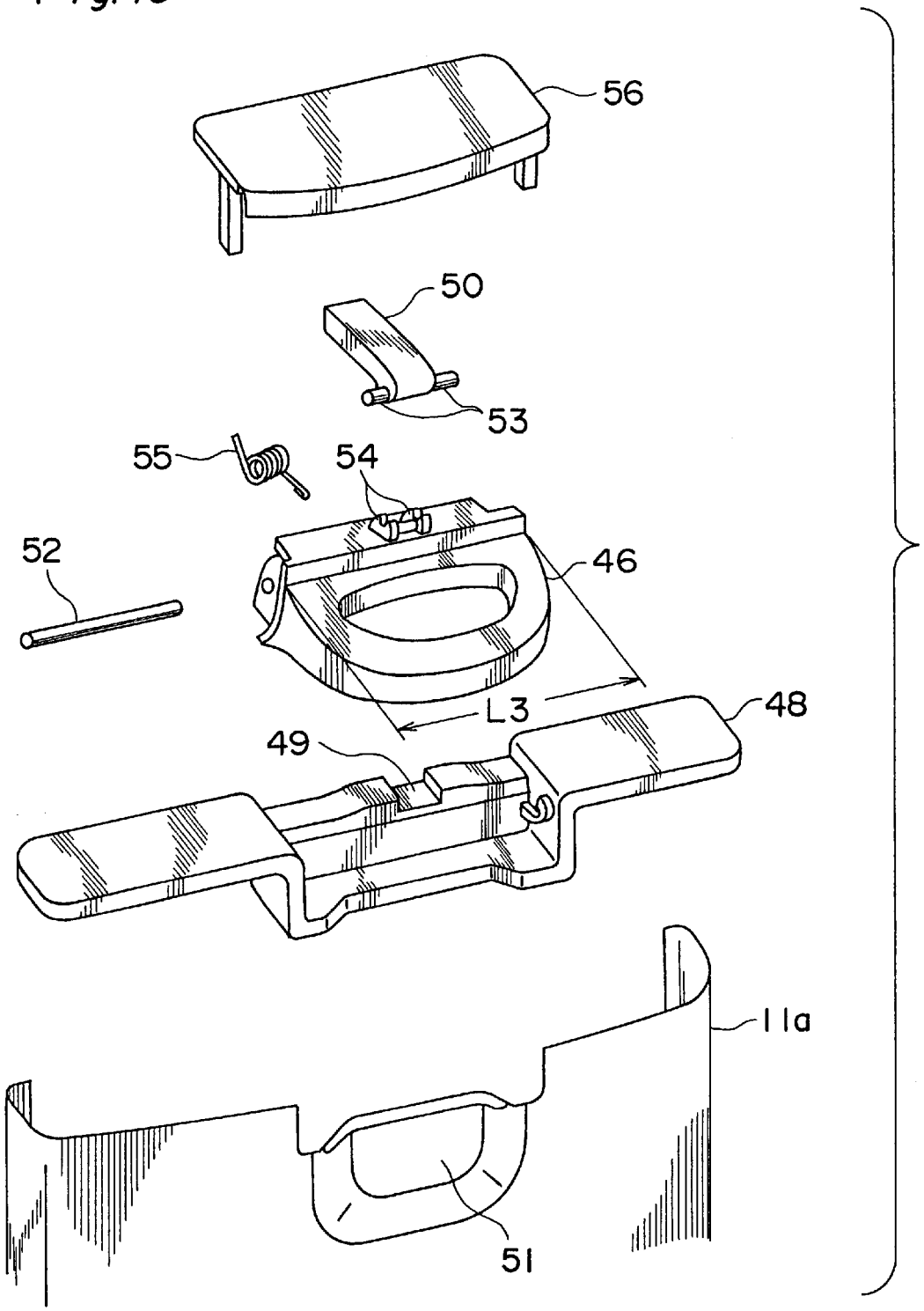
FIG. 15 is an exploded view of the door handle of the drawing door shown in FIGS. 13 and 14.

The pivot handle 46 has an upper portion pivotally supported within the recess 51 by virtue of a pivot pin 52 mounted on the decorative plate 48 so as to straddle the recess 51. The slidable trigger piece 50 is formed with pins 53 protruding laterally outwardly from one end thereof, and is operatively coupled with the handle 46 with the pins 53 received in respective engagement grooves 54. An elastic member 55 such as, for example, a coil spring has its opposite ends held in contact with the handle 46 and a bottom of the recess 51 to urge the handle 46 normally towards the closed position as shown in FIG. 13, and hence to urge the slidable trigger piece 50 towards the retracted position. With the slidable trigger piece 50 so positioned at the retracted position as shown in FIG. 13, one end of the slidable trigger piece 50 remote from the handle 46 is spaced a slight distance from an associated partition brim 13.

Reference numeral 56 represents a covering mounted on the decorative plate 48 so as to overhang the slidable trigger piece 50 and also to cover a top front portion of the handle 46. As with the foregoing embodiment, the slidable trigger piece 50 is positioned within an area encompassed by length L3 of the pivot handle 46 as measured in a direction widthwise of the refrigerator housing 5. Since the covering 56 is used to cover that end portion of the handle 46 in the hingedly supported door 9, there is no possibility that a user's hand will be jammed by that end portion of the handle.

Also, since uppermost drawing door 10 is provided with a storage container that is shallower and lighter than respective storage containers of the other drawing doors 11 and 12, it can be opened with a slight force even though the handle is not designed to be of a movable type, and elimination of use of a movable handle makes it possible to reduce cost.

It is to be noted that the handles 24 and 46 employed in the second embodiment of the present invention bring about effects and advantages similar to those discussed in connection with the foregoing embodiment of the present invention.

Figure 16:
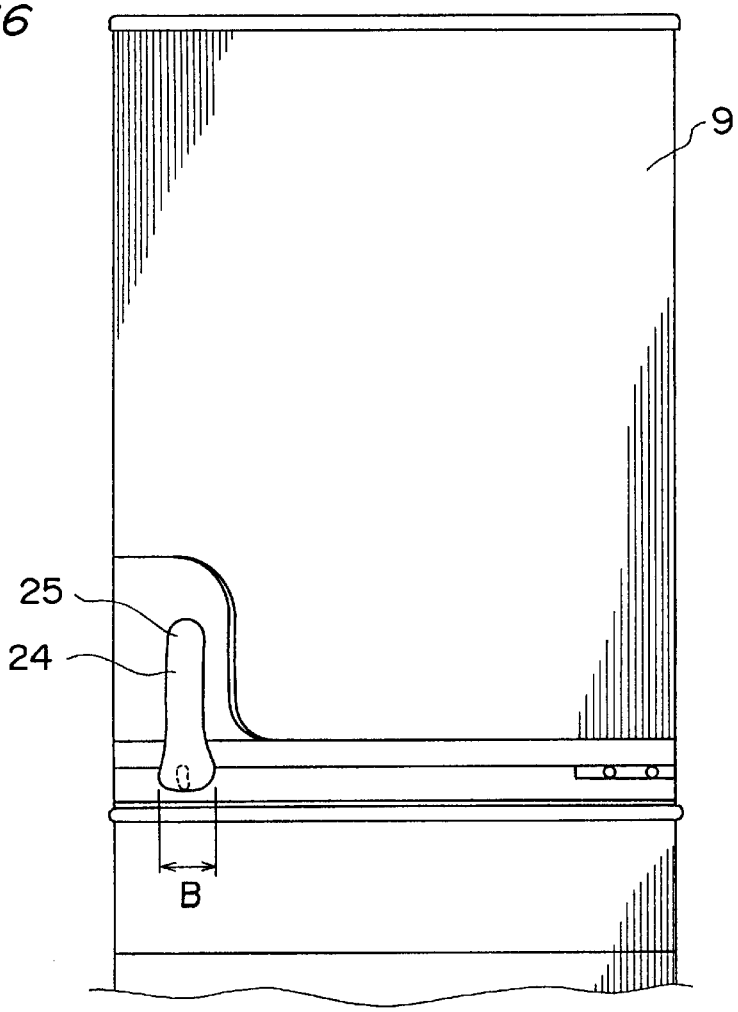
FIG. 16 is a fragmentary front elevational view of a refrigerator according to a third preferred embodiment of the present invention, showing only an upper portion of the refrigerator.
Figure 17:
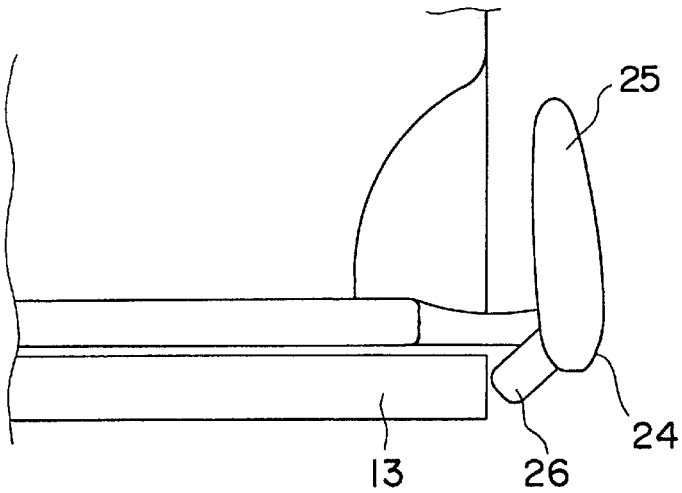
FIG. 17 is a schematic side sectional view of a portion of the refrigerator shown in FIG. 16.

Third Embodiment (FIGS. 16 and 17)

Referring now to FIGS. 16 and 17, hinged handle 24 is pivotally connected to a bottom left corner of hingedly supported door 9 remote from a hinge with its grip 25 extending upright in a direction conforming to a longitudinal direction of refrigerator housing 5. Accordingly, dimension B of the handle 24 having the grip 25 as measured in a direction widthwise of the hingedly supported door 9 can be minimized, thereby making it difficult for a user and his or her clothing to be caught thereby. Also, during use, the handle 24 moves to push a portion of the refrigerator housing 5 and, accordingly, a force necessary to selectively open and close the hingedly supported door 9 can advantageously be minimized.

Figure 18:
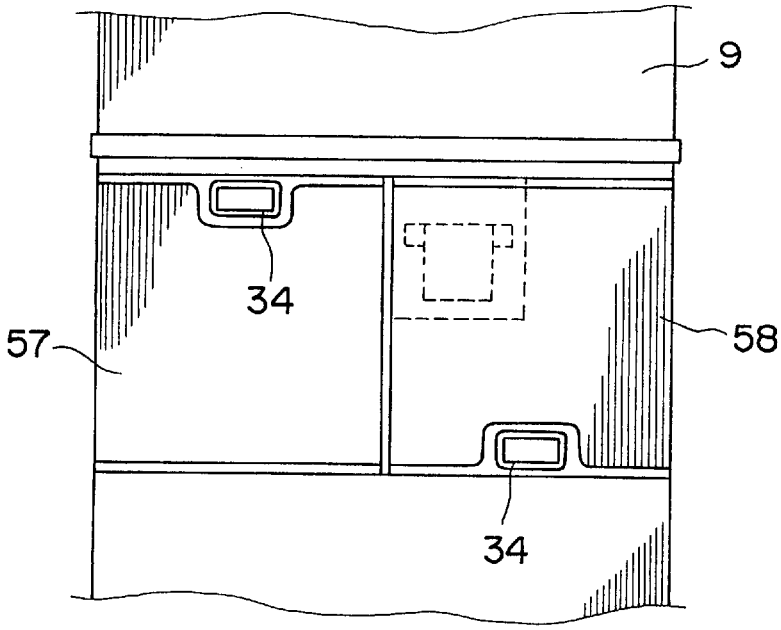
FIG. 18 is a fragmentary front elevational view of a refrigerator according to a fourth preferred embodiment of the present invention.

Fourth Embodiment (FIG. 18)

In a fourth preferred embodiment of the present invention, refrigerator housing 5 has drawing doors 57 and 58 juxtaposed in a side-by-side relationship and positioned at a location generally intermediate a height of the refrigerator housing 5. Although not shown, these drawing doors 57 and 58 include respective storage containers. As viewed in FIG. 18, the left drawing door 57 has the handle 34 positioned at a top middle portion thereof and the right drawing door 58 has handle 34 positioned at a bottom middle portion. While the handle 34 of the left drawing door 57, when pulled to pivot, moves forwardly and upwardly, the handle 34 of the right drawing door 58 is, when pulled to pivot, moved forwardly and downwardly.

While structure and operation of these handles 34 of the left and right drawing doors 57 and 58 are substantially identical with each other and are not therefore reiterated, it should be noted that operability of each of the handles 34 will not be adversely affected by a specific layout of these handles.

Figure 19:
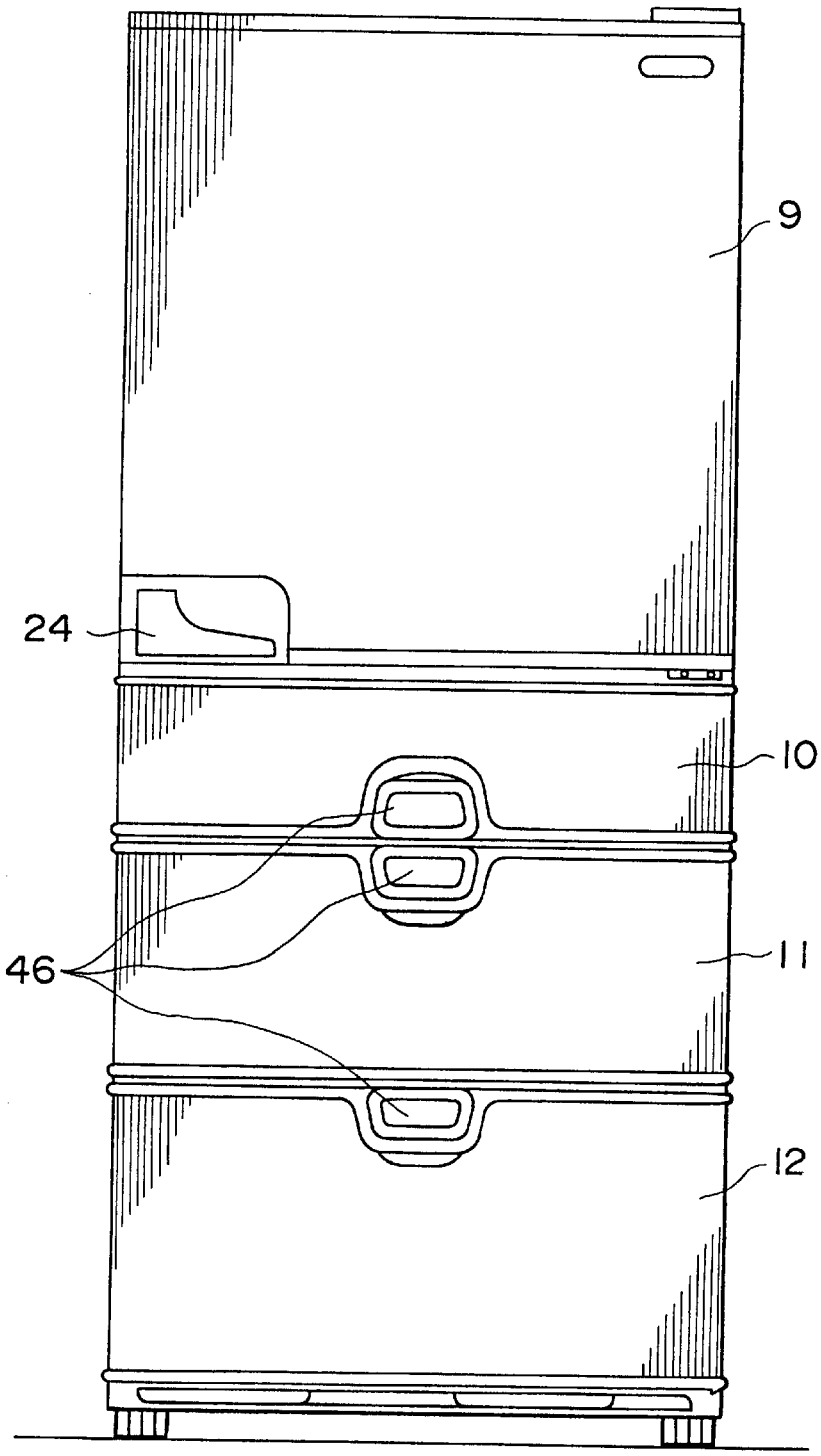
FIG. 19 is a front elevational view of a refrigerator according to a fifth preferred embodiment of the present invention.

Fifth Embodiment (FIG. 19)

In a fifth preferred embodiment of the present invention shown in FIG. 19, uppermost drawing door 10 has handle 46 positioned at a bottom middle portion thereof, whereas intermediate drawing door 11 has handle 46 positioned at a top middle portion thereof so as to confront the handle 46 in the uppermost drawing door 10. Accordingly, the handle 46 of the uppermost drawing door 10, although substantially identical in structure with handle 46 of the intermediate drawing door 11, is reversed relative to the handle 46 of the intermediate drawing door 11 and, therefore, while the handle 46 of the intermediate drawing door 11, when pulled to pivot, moves forwardly and upwardly, the handle 46 of the uppermost drawing door 10 is, when pulled to pivot, moved forwardly and downwardly.

While structure and operation of these handles 46 of the drawing doors 10 and 11 are substantially identical with each other and are not therefore reiterated for the sake of brevity, it should be noted that operability of each of the handles 46 will not be adversely affected by a specific layout of these handles.

Figure 20:
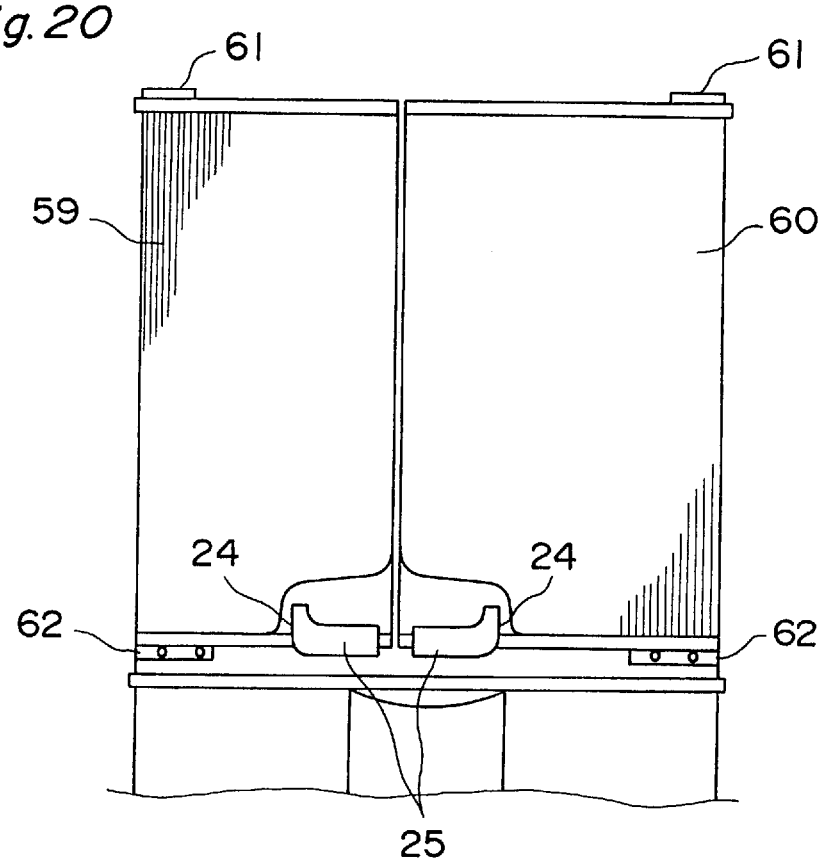
FIG. 20 is a fragmentary front elevational view of a refrigerator according to a sixth preferred embodiment of the present invention.

Sixth Embodiment (FIG. 20)

In a sixth preferred embodiment of the present invention shown in FIG. 20, a concept of the present invention is applied to a refrigerator of the type employing a casement door assembly including left and right swing doors 59 and 60 each hingedly supported by a respective pair of upper and lower hinge pins 61 and 62.

Left swing door 59 has a bottom right corner provided with handle 24, whereas right swing door 60 has a bottom left corner provided with handle 24. These handles 24 associated respectively with the swing doors 59 and 60 include respective trigger pieces which are arranged symmetrically so as to be engageable with partition brim 13, and are arranged with their grips 25 extending generally horizontally in a direction widthwise of refrigerator housing 5. Also, although not shown, a magnetic gasket is at this time held in sealing contact with three sides of the refrigerator housing.

Pivot handles can be applied even to the casement door assembly as discussed with reference to FIG. 20. In addition, the pivot handles 20 applied to the casement door assembly can be tailored and designed aesthetically to provide a refrigerator having appealing features.

Figure 21:
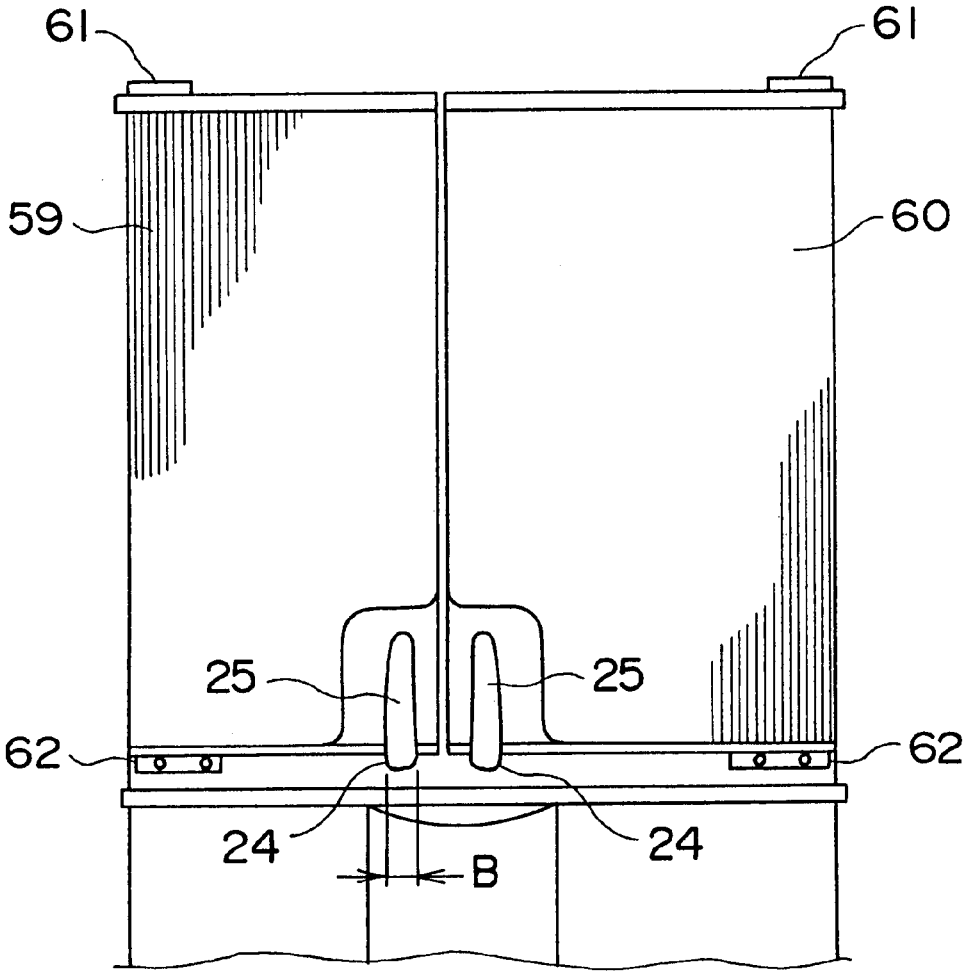
FIG. 21 is a fragmentary front elevational view of a refrigerator according to a seventh preferred embodiment of the present invention.

Seventh Embodiment (FIG. 21)

Even in a seventh preferred embodiment of the present invention shown in FIG. 21, a concept of the present invention is applied to a refrigerator of the type employing a casement door assembly similar to that used in the sixth embodiment and including left and right swing doors 59 and 60, each hingedly supported by a respective pair of upper and lower hinge pins 61 and 62.

The left swing door 59 has a bottom right corner provided with handle 24 with its grip 25 oriented upright in a direction parallel to a longitudinal direction of refrigerator housing 5, whereas the right swing door 60 has a bottom left corner provided with handle 24 with its grip 25 oriented upright in a direction parallel to the longitudinal direction of the refrigerator housing 5 and parallel with the grip 25 of the handle 24 in the left swing door 59. Although not shown, a magnetic gasket is at this time held in sealing contact with three sides of the refrigerator housing.

Pivot handles can be applied even to the casement door assembly as discussed with reference to FIG. 21. In addition, the pivot handles applied to the casement door assembly can be tailored and designed aesthetically to provide a refrigerator having appealing features. In addition, since dimension B of each of the handles 24, having the respective grips 25, as measured in a direction widthwise of hingedly supported door 9 can be minimized, it is possible to minimize a possibility of a user and his or her clothing being caught thereby.

Figure 22:
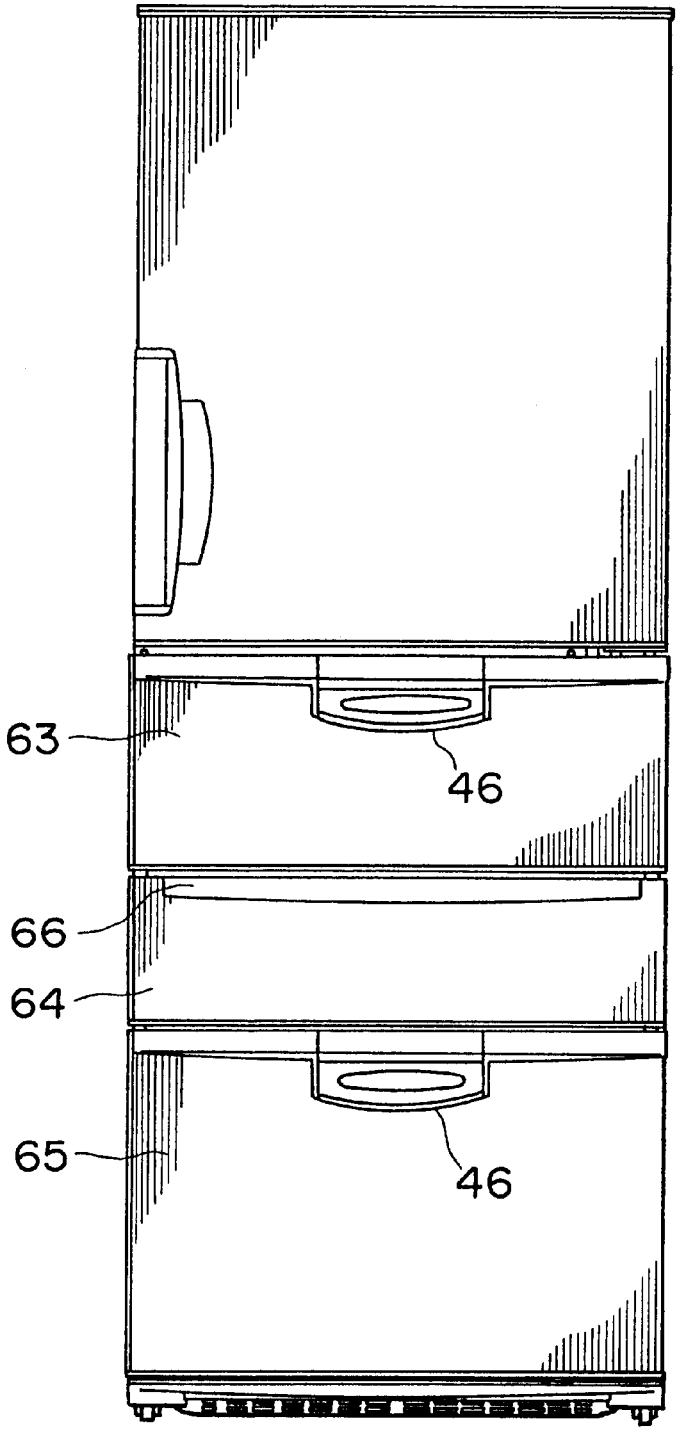
FIGS. 22 and 23 are front elevational views of refrigerators according to eighth and ninth preferred embodiments of the present invention, respectively.

Eighth Embodiment (FIG. 22)

Referring to FIG. 22 showing an eighth preferred embodiment of the present invention, reference numerals 63, 64 and 65 represent respective drawing doors each movable between a forwardly drawn, open position and a rearwardly retracted, closed position along guide rails (not shown), and each including a corresponding storage container (not shown) fitted thereto while opening upwardly. As far as depth and capacity are concerned, the storage container fitted to intermediate drawing door 64 has the smallest of all of the storage containers, i.e., similar to storage container 21 of FIG. 2. The storage container associated with uppermost drawing door 63 is used as a crispy container for accommodating vegetables, the storage container associated with the intermediate drawing door 64 is used as a multi-purpose container, and the storage container associated with lowermost drawing door 65 is used as a freezer container.

Since the intermediate drawing door 64 has the storage container which is of the smallest size as compared with the storage containers associated with the uppermost and lowermost drawing doors 63 and 65, and is therefore light-weight, handle 66 associated therewith is of any known pull-type structure, whereas only the drawing doors 63 and 65 are provided with pivotable grip handles 46.

It is to be noted that the multi-purpose storage container associated with the intermediate drawing door 64 may be cooled to a temperature generally intermediate freezing and refrigerating temperatures, and may therefore be used to accommodate perishables such as fishes and/or meats, or may be designed so as to be cooled to any desired temperature between the freezing and refrigerating temperatures via a provision of a specially designed damper (not shown) so that the intermediate storage container can be used as desired to provide a food storage space.

In this structure described with reference to FIG. 22, since the light-weight storage container of a shallow depth, as compared with the storage containers associated with the drawing doors 63 and 65, is fitted to the intermediate drawing door 64, it can be opened with a slight force even though its associated handle is not designed to be of a movable type, and elimination of use of a movable handle makes it possible to reduce cost. It is pointed out that in view of health care being considered to be important in recent years, a design has been made in which a crispy container, which is most often accessed, is preferentially placed at a level of the refrigerator at which a user can gain an entire perspective of the crispy container without being forced to bow and, therefore, the layout of the drawing doors according to the embodiment shown in FIG. 22, in which the drawing door of the smallest height is placed at a portion of refrigerator housing 5 that is generally intermediate a height thereof, is effective to increase utility of the refrigerator embodying the present invention.

Figure 23:
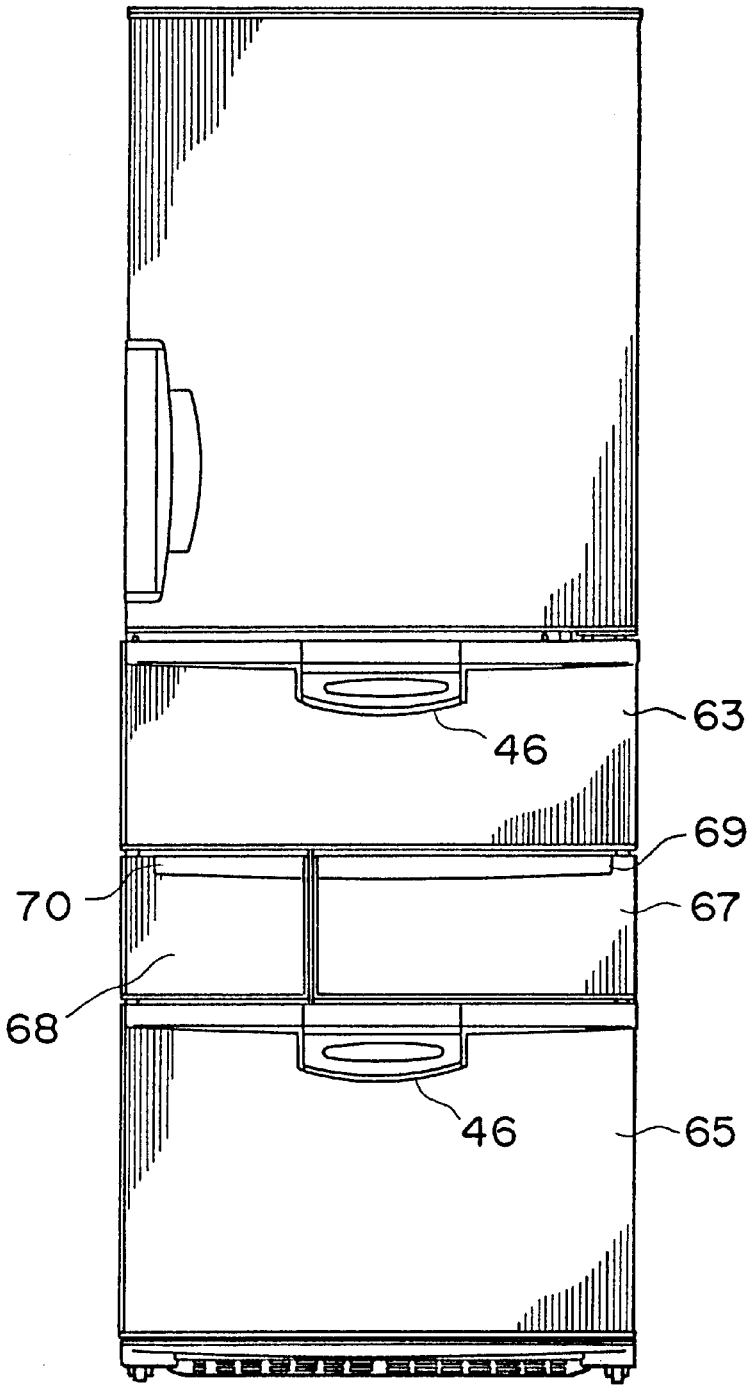

Ninth Embodiment (FIG. 23)

In FIG. 23, reference numerals 67 and 68 represent right and left drawing doors, respectively, which are positioned between uppermost drawing door 63 and the lowermost drawing door 65. Each of the right and left drawing doors 67 and 68 is movable between a forwardly drawn, open position and a rearwardly retracted, closed position along guide rails (not shown), and each includes a corresponding storage container (not shown) fitted thereto while opening upwardly. As far as depth and capacity are concerned, the respective storage containers fitted to the right and left drawing doors 67 and 68 are small as compared with storage containers associated with the uppermost and lowermost drawing doors 63 and 65 (see the storage container 21 of FIG. 2 for a depth of the storage containers fitted to drawing doors 67 and 68). In this illustrated embodiment, the storage container associated with the right drawing door 67 is used as a multi-purpose container, whereas the storage container associated with the left drawing door 68 is used as an icing chamber. Since as compared with any of the drawing doors 63 and 65, each of the drawing doors 67 and 68 has a respective storage container having a relatively small depth and a relatively small width, and is therefore light-weight, any of the drawing doors 67 and 68 can be opened with a sufficiently small force even though no movable handle is employed, thereby making it possible to reduce cost.

In addition, in view of health care being considered important in recent years, a design has been made in which a crispy container, which is most often accessed, is preferentially placed at a level of the refrigerator at which a user can gain an entire perspective of the crispy container without being forced to bow and, therefore, the layout of the drawing doors according to the embodiment shown in FIG. 23, in which the drawing door of the smallest height is placed at a portion of the refrigerator housing 5 that is generally intermediate a height thereof is effective to increase utility of the refrigerator embodying the present invention.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A refrigerator comprising:

a thermally insulated housing having an opening at a front surface thereof, said opening being defined by sidewalls, a back wall, a top wall and a bottom wall of said thermally insulated housing, a door hingedly connected to said thermally insulated housing for selectively opening and closing said opening, with said door being hingedly connected to said thermally insulated housing about an axis that extends orthogonally to said top wall and bottom wall; and a pivotally supported handle connected to said door for opening and closing said door, said handle including a grip for movement between opened and closed positions and also including a trigger piece opposite said grip, said trigger piece being spaced from one of said top wall and bottom wall when said grip is in the closed position, such that when said grip is pulled toward the opened position said trigger piece exerts a force against said one of said top wall and bottom wall and pivots said door so as to open said door.

2. The refrigerator according to claim 1, further comprising:

a magnetic gasket attached to said door so as to be engageable with an edge portion of said thermally insulated housing when said door closes said opening.

3. The refrigerator according to claim 2, wherein said one of said top wall and bottom wall includes a brim on a front face thereof such that when said grip is in the closed position said grip is spaced from said brim, and when said grip is pulled toward the opened position said trigger piece exerts the force against said one of said top wall and bottom wall by being brought into contact with said brim so as to pivot said door and open said door.

4. The refrigerator according to claim 3, wherein said brim comprises one of a metal brim and a synthetic resin brim attached to said front face of said one of said top wall and bottom wall.

5. The refrigerator according to claim 3, further comprising:

a partition wall for dividing an interior of said thermally insulated housing into plural compartments, wherein said one of said top wall and said bottom wall comprises said partition wall and is said bottom wall.

6. The refrigerator according to claim 5, wherein said door is hingedly connected to said thermally insulated housing by coaxially aligned hinges and said grip extends substantially horizontally on a side of said door opposite said coaxially aligned hinges.

7. The refrigerator according to claim 6, further comprising:

an elastic member for biasing said grip towards said closed position.

8. The refrigerator according to claim 6, wherein said trigger piece is positioned exterior of said magnetic gasket.

9. The refrigerator according to claim 6, wherein said trigger piece comprises a synthetic resin trigger piece and said brim comprises an iron plate.

10. The refrigerator according to claim 6, wherein said trigger piece comprises a synthetic resin trigger piece and said brim comprises a synthetic resin brim.

11. The refrigerator according to claim 6, wherein said grip comprises a grip of a material mixed with an antimicrobial agent so as to provide said grip with an antimicrobial characteristic.

12. The refrigerator according to claim 6, wherein said grip includes a knurled surface so as to provide said grip with surface irregularities.

13. The refrigerator according to claim 1, further comprising:

a partition wall dividing an interior of said thermally insulated housing into upper and lower compartments, wherein said one of said top wall and said bottom wall comprises said partition wall and is said bottom wall such that said opening to be closed by said door is an opening of said upper compartment;

a drawing door slidably connected to said thermally insulated housing for selectively opening and closing an opening of said lower compartment;

a pivotal handle connected to said drawing door for movement between opened and closed positions for opening and closing said drawing door, respectively, said pivotal handle having a presser face and a pull face; and a trigger member for exerting a force against an edge portion of said thermally insulated housing and being drivingly coupled with said pivotal handle for movement between projected and retracted positions, such that when said pivotal handle is moved from the closed position to the opened position said presser face moves said trigger member from the retracted position to the projected position so as to exert the force against said edge portion, when said pivotal handle is moved from the opened position to the closed position said pull face moves said trigger member from the projected position to the retracted position, and when said pivotal handle is in the closed position said trigger member is in the retracted position and spaced from said edge portion.

14. The refrigerator according to claim 13, further comprising:

a first magnetic gasket attached to said door so as to be engageable with said thermally insulated housing when said door closes said opening of said upper compartment; and a second magnetic gasket attached to said drawing door so as to be engageable with said thermally insulated housing when said drawing door closes said opening of said lower compartment.

15. The refrigerator according to claim 14, wherein said partition wall includes a partition brim on a front face thereof such that when said grip is in the closed position said grip is spaced from said partition brim, and when said grip is pulled toward the opened position said trigger piece exerts the force against said partition wall by being brought into contact with said partition brim so as to pivot said door and open said door.

16. The refrigerator according to claim 15, wherein when said pivotal handle is in the closed position said trigger member is in the retracted position and spaced from said partition brim, and when said pivotal handle is moved from the closed position to the opened position said presser face moves said trigger member from the retracted position to the projected position so as to exert the force against said edge portion by bringing said trigger member into contact with said partition brim.

17. The refrigerator according to claim 16, wherein said pivotal handle includes a grip member that is constructed and arranged such that upon movement of said grip member forwardly and upwardly said pivotal handle pivots from the closed position toward the opened position so as to cause said trigger member, via said presser face, to move from the retracted position toward the projected position.

18. The refrigerator according to claim 15, wherein said door is hingedly connected to said thermally insulated housing by coaxially aligned hinges and said grip extends substantially horizontally on a side of said door opposite said coaxially aligned hinges.

19. The refrigerator according to claim 18, further comprising:

an elastic member for biasing said grip towards said closed position.

20. The refrigerator according to claim 18, wherein said trigger piece is positioned exterior of said first magnetic gasket.

21. The refrigerator according to claim 1, further comprising:

plural partition walls dividing an interior of said thermally insulated housing into plural compartments, wherein said one of said top wall and said bottom wall comprises an uppermost one of said plural partition walls and is said bottom wall such that said opening to be closed by said door is an opening of an uppermost one of said plural compartments;

drawing doors slidably connected to said thermally insulated housing for selectively opening and closing respective other openings of said plural compartments;

pivotal handles connected to said drawing doors, respectively, for movement between opened and closed positions for opening and closing said drawing doors, respectively, said pivotal handles each having a presser face and a pull face; and trigger members for respectively exerting forces against edge portions of said thermally insulated housing and being respectively drivingly coupled with said pivotal handles for movement between projected and retracted positions, such that when said pivotal handles are respectively moved from the closed position to the opened position said presser faces respectively move said trigger members from the retracted position to the projected position so as to respectively exert the forces against said edge portions, when said pivotal handles are respectively moved from the open position to the closed position said pull faces respectively move said trigger members from the projected position to the retracted position, and when said pivotal handles are respectively in the closed position said trigger members are in the retracted position and respectively spaced from said edge portions.

22. The refrigerator according to claim 21, further comprising:

a first magnetic gasket attached to said door so as to be engageable with said thermally insulated housing when said door closes said opening of said upper compartment; and second magnetic gaskets respectively attached to said drawing doors so as to be engageable with said thermally insulated housing when said drawing doors respectively close said respective other openings.

23. The refrigerator according to claim 22, wherein said uppermost one of said partition walls includes a partition brim on a front face thereof such that when said grip is in the closed position said grip is spaced from said partition brim, and when said grip is pulled toward the opened position said trigger piece exerts the force against said uppermost one of said partition walls by being brought into contact with said partition brim so as to pivot said door and open said door.

24. The refrigerator according to claim 23, wherein each other of said partition walls includes another partition brim on a front face thereof such that when said pivotal handles are respectively in the closed position said trigger members are respectively in the retracted position and spaced from a respective said another partition brim, and when said pivotal handles are respectively moved from the closed position to the opened position said presser faces respectively move said trigger members from the retracted position to the projected position so as to respectively exert the forces against said edge portions by bringing said trigger members into contact with said respective said another partition brim.

25. The refrigerator according to claim 24, wherein said pivotal handles each includes a grip member that is constructed and arranged such that upon movement of a respective said grip member forwardly and upwardly a respective one of said pivotal handles pivots from the closed position toward the opened position so as to cause a respective said trigger member, via a respective said presser face, to move from the retracted position toward the projected position.

26. The refrigerator according to claim 23, wherein said door is hingedly connected to said thermally insulated housing by coaxially aligned hinges and said grip extends substantially horizontally on a side of said door opposite said coaxially aligned hinges.

27. The refrigerator according to claim 26, further comprising:

an elastic member for biasing said grip towards said closed position.

28. The refrigerator according to claim 26, wherein said trigger piece is positioned exterior of said first magnetic gasket.

29. A refrigerator comprising:

a thermally insulated housing having an opening at a front surface thereof;

a door slidably connected to said thermally insulated housing for selectively opening and closing said opening;

a pivotally supported handle connected to said door for movement between opened and closed positions for opening and closing said door, respectively, said handle having a presser face and a pull face; and a trigger member for exerting a force against an edge portion of said thermally between projected and retracted positions, such that when said handle is moved from the closed position to the opened position said presser face moves said trigger member from the retracted position to the projected position so as to exert the force against said edge portion, when said handle is moved from the opened position to the closed position said pull face moves said trigger member from the projected position to the retracted position, and when said handle is in the closed position said trigger member is in the retracted position and spaced from said edge portion.

30. The refrigerator according to claim 29, further comprising:

a magnetic gasket attached to said door and located between said door and an edge portion of said thermally insulated housing.

31. The refrigerator according to claim 30, wherein said handle is at a top portion of said door.

32. The refrigerator according to claim 31, wherein said pivotal handle includes a grip member that is constructed and arranged such that upon movement of said grip member forwardly and upwardly said pivotal handle pivots from the closed position toward the opened position so as to cause said trigger member, via said presser face, to move from the retracted position toward the projected position.

33. The refrigerator according to claim 30, wherein said handle is at a bottom portion of said door.

34. The refrigerator according to claim 30, wherein said handle is at a bottom middle portion of said door or a top middle portion of said door.

35. A refrigerator comprising:

a thermally insulated housing having an opening at a front surface thereof;

a partition wall dividing an interior of said thermally insulated housing into upper and lower compartments, said partition wall having a partition brim formed at a front face thereof;

a door hinged to one side of said thermally insulated housing by a hinge for selectively opening and closing one of said upper and lower compartments;

a magnetic gasket fitted to said door;

a pivotally supported handle connected to a portion of said door remote from said hinge for movement between opened and closed positions for opening and closing said door, respectively; and a trigger member engageable with said partition brim and drivingly coupled with said handle for movement between (i) a retracted position, at which said trigger member is spaced from said partition brim, when said handle is in the closed position, and (ii) a projected position when said handle is in the opened position, such that when said handle is moved from the closed position toward the opened position said trigger member is moved from the retracted position to the projected position to abut said partition brim so as to physically release said magnetic gasket from contact with said partition brim, wherein said partition brim has a thickness greater than a wall thickness of said thermally insulated housing.

* * * * *

UNITED STATES PATENT AND TRADEMARK OFFICE

CERTIFICATE OF CORRECTION

PATENT NO. : 6,655,765 B2
DATED : December 2, 2003
INVENTOR(S) : Tadahiro Kawamura et al.

It is certified that error appears in the above-identified patent and that said Letters Patent is hereby corrected as shown below:

Title page,
Item [63], Related U.S. Application Data, change "Continuation of application No. 09/744,913, filed on Apr. 20, 2001, now abandoned." to -- Continuation of application No. 09/744,913, filed on Apr. 20, 2001, which is a National Stage application corresponding to PCT/JP99/04163, filed August 3,1999, now abandoned.--.

Column 1,
Line 2, change "Continuation of application No. 09/744,913, filed on Apr. 20, 2001, now abandoned." to -- Continuation of application No. 09/744,913, filed on Apr. 20, 2001, which is a National Stage application corresponding to PCT/JP99/04163, filed August 3, 1999, now abandoned. --

Column 16,
Line 66, please replace "thermally between" with -- thermally insulated housing and being drivingly coupled with said pivotal handle for movement between --.

Signed and Sealed this

Eighteenth Day of May, 2004

JON W. DUDAS
*Acting Director of the United States Patent and Trademark Office*